US007025597B1

(12) United States Patent
Chang

(10) Patent No.: US 7,025,597 B1
(45) Date of Patent: Apr. 11, 2006

(54) BATTERY CONDUCTING DEVICE FOR MOTORIZED SCOOTER

(75) Inventor: Feng-Chu Chang, Taipei Hsien (TW)

(73) Assignee: Chienti Enterprise Co., Ltd., Hsin Chang (TW)

( * ) Notice: Subject to any disclaimer, the term of this patent is extended or adjusted under 35 U.S.C. 154(b) by 0 days.

(21) Appl. No.: 11/158,124

(22) Filed: Jun. 21, 2005

(51) Int. Cl.
*H01R 13/30* (2006.01)

(52) U.S. Cl. ..... 439/39

(58) Field of Classification Search ..... 439/38–40
See application file for complete search history.

(56) References Cited

U.S. PATENT DOCUMENTS 3,521,216 A * 7/1970 Tolegian ..... 439/39
4,917,612 A * 4/1990 Priest ..... 439/39
5,779,487 A * 7/1998 Gatin ..... 439/39
5,921,783 A * 7/1999 Fritsch et al. ..... 439/38
5,954,520 A * 9/1999 Schmidt ..... 439/39
6,030,229 A * 2/2000 Tsutsui ..... 439/39
6,464,509 B1 * 10/2002 Emberty et al. ..... 439/39
6,966,781 B1 * 11/2005 Bullinger et al. ..... 439/38
2002/0086559 A1 * 7/2002 Ferrerfabrega et al. ..... 439/39
2004/0077187 A1 * 4/2004 Belongia et al. ..... 439/39
2004/0161951 A1 * 8/2004 Hartman et al. ..... 439/39

* cited by examiner

*Primary Examiner*—Ross Gushi
(74) *Attorney, Agent, or Firm*—Alan D. Kamrath; Nikolai & Mersereau, P.A.

(57) ABSTRACT

A battery conducting device for a motorized scooter includes a fixing seat, a permanent magnet movably mounted in the chamber of the fixing seat, a bolt movably mounted on the fixing seat and having a flat plate rested on the permanent magnet, and an electrode contact member rested on the flat plate and attracted by the permanent magnet so that the electrode contact member is bonded on the flat plate closely. Thus, the flat plate is connected to the electrode contact member constantly, so that the bolt is connected to the battery constantly, thereby connecting the battery to the motor power supply input successively so as to supply an electric power to the motorized scooter successively without interruption due to a shock or vibration.

17 Claims, 5 Drawing Sheets

BATTERY CONDUCTING DEVICE FOR MOTORIZED SCOOTER

BACKGROUND OF THE INVENTION

1. Field of the Invention

The present invention relates to a battery conducting device, and more particularly to a battery conducting device for a motorized scooter.

2. Description of the Related Art

A conventional motorized scooter comprises a vehicle body, a frame mounted on the vehicle body, and a battery mounted on the frame by a plurality of screws. However, it is necessary to unscrew and screw the screws when replacing the battery, thereby causing inconvenience to the user.

Another conventional motorized scooter comprises a vehicle body, a battery mounted on the vehicle body, and at least one detachable bonding strap mounted between the battery and the vehicle body to secure the battery on the vehicle body. However, the detachable bonding strap cannot fasten the battery on the vehicle body closely, so that the battery is easily detached from the vehicle body due to a shock or vibration, thereby interrupting the electric power supplied by the battery.

SUMMARY OF THE INVENTION

In accordance with the present invention, there is provided a battery conducting device, comprising a fixing seat having a first side formed with a chamber, a permanent magnet movably mounted in the chamber of the fixing seat, a bolt movably mounted on the fixing seat and having a first end formed with a flat plate rested on the permanent magnet, and an electrode contact member rested on the flat plate of the bolt and attracted by the permanent magnet so that the electrode contact member is bonded on the flat plate of the bolt closely, and the flat plate of the bolt is movable with the electrode contact member.

The primary objective of the present invention is to provide a battery conducting device having a constantly conducting function without incurring power supply interruption due to a shock or vibration.

Another objective of the present invention is to provide a battery conducting device, wherein the flat plate of the bolt is connected to the electrode contact member constantly, so that the bolt is connected to the battery constantly, thereby connecting the battery to the motor power supply input successively so as to supply an electric power to the motorized scooter successively without interruption due to a shock or vibration.

A further objective of the present invention is to provide a battery conducting device, wherein the compression spring mounted on the bolt provides a shock-absorbing function to reduce the shock or vibration applied on the motorized scooter.

A further objective of the present invention is to provide a battery conducting device, wherein the battery is secured on the vehicle body of the motorized scooter rigidly and stably by the bonding straps.

Further benefits and advantages of the present invention will become apparent after a careful reading of the detailed description with appropriate reference to the accompanying drawings.

DETAILED DESCRIPTION OF THE INVENTION

Figure 1:
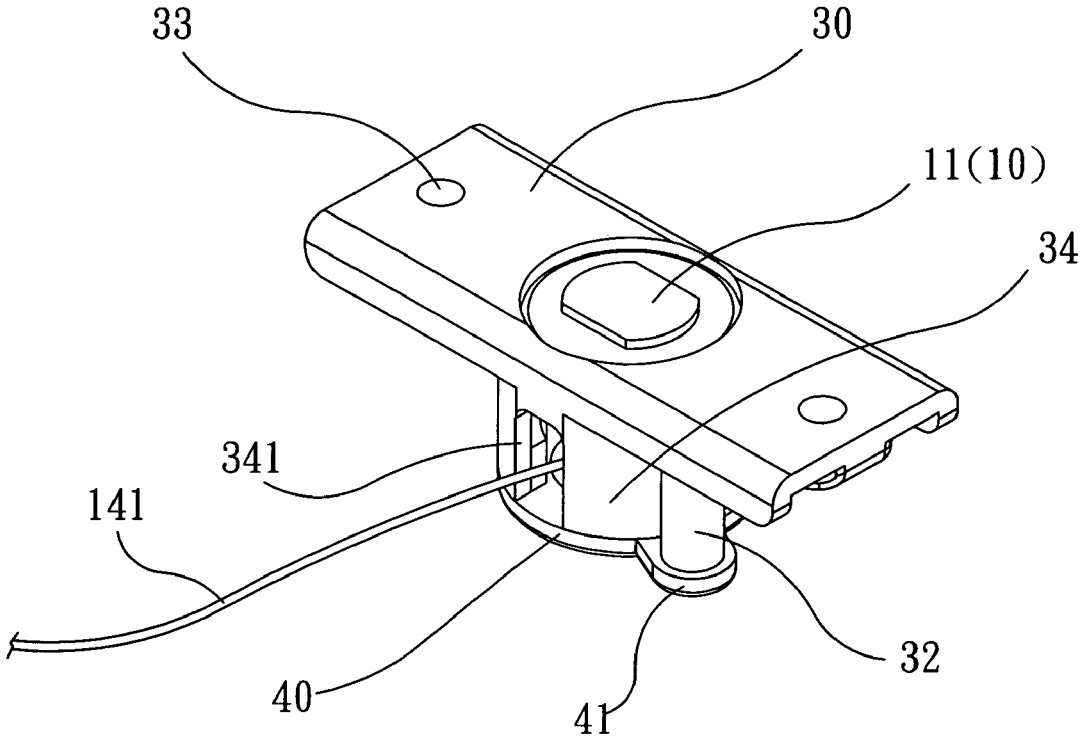
FIG. 1 is a perspective view of a battery conducting device in accordance with the preferred embodiment of the present invention.
Figure 2:
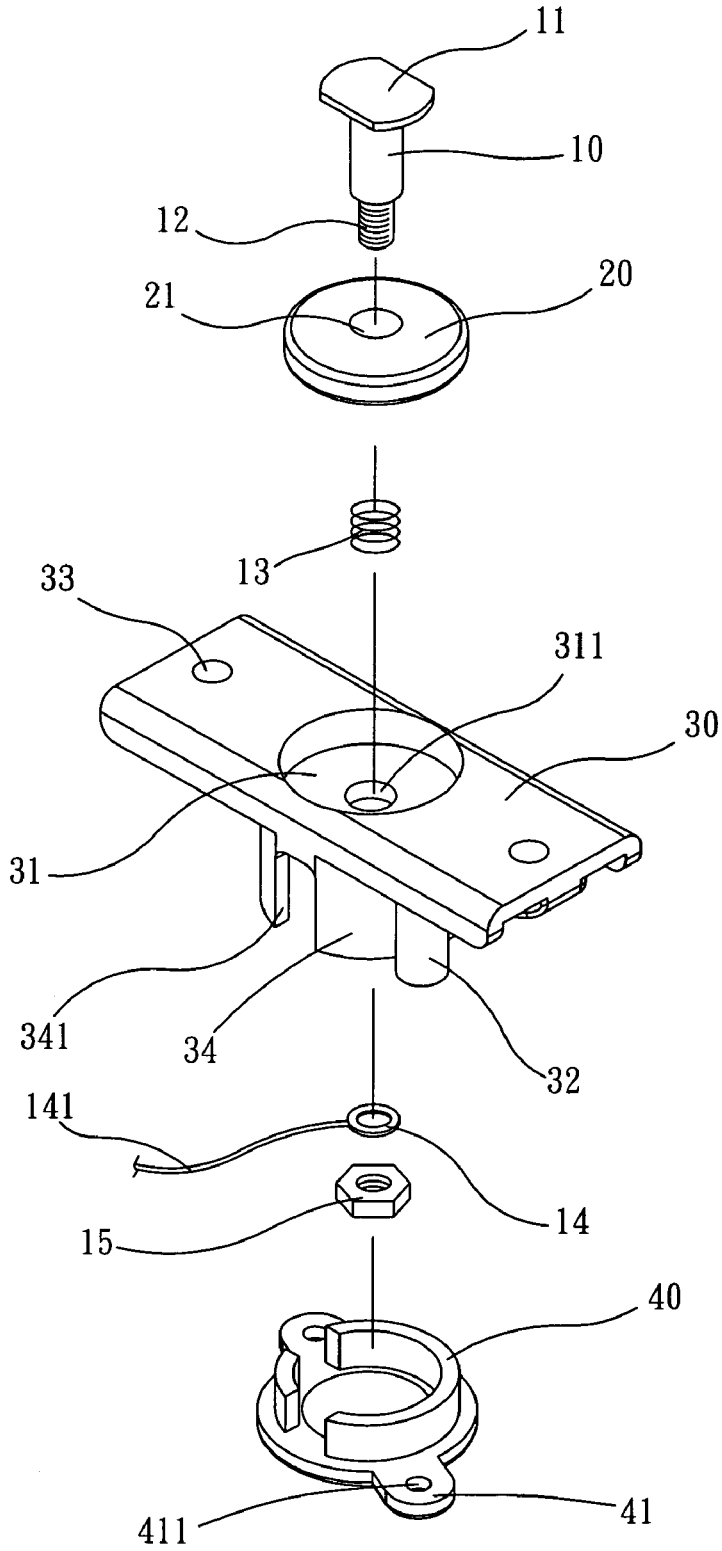
FIG. 2 is an exploded perspective view of the battery conducting device as shown in FIG. 1.
Figure 3:
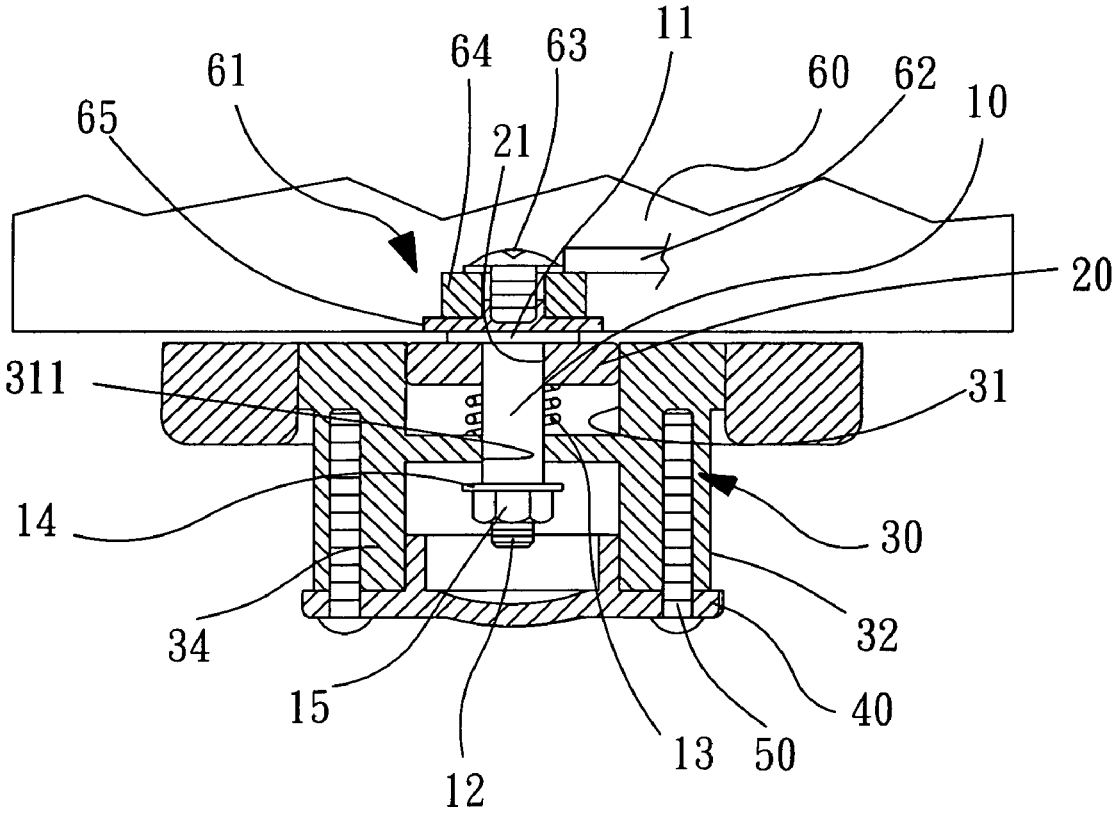
FIG. 3 is a plan cross-sectional view of the battery conducting device as shown in FIG. 1.

Referring to the drawings and initially to FIGS. 1–3, a battery conducting device for a motorized scooter in accordance with the preferred embodiment of the present invention comprises a fixing seat 30, a permanent magnet 20, a bolt 10, a cover 40, and an electrode contact member 61.

The fixing seat 30 is a substantially sheet plate and has a first side formed with a chamber 31 having a face formed with a through hole 311 and a second side formed with a substantially cylindrical peripheral wall 34 having a side formed with an opening 341. The peripheral wall 34 of the fixing seat 30 has an outside formed with two radially opposite threaded posts 32. The fixing seat 30 has two ends each formed with a fixing hole 33.

The permanent magnet 20 is an annular magnet having a relatively stronger magnetically attractive force. The permanent magnet 20 is movably mounted in the chamber 31 of the fixing seat 30 and has an inside formed with a through hole 21.

The bolt 10 is movably mounted on the fixing seat 30 and has a first end formed with a flat plate 11 rested on the permanent magnet 20 and a second end extended the through hole 311 of the fixing seat 30 into the peripheral wall 34 of the fixing seat 30 and formed with an outer thread 12. The bolt 10 is extended through the through hole 21 of the permanent magnet 20 and movably mounted in the through hole 311 of the fixing seat 30.

A compression spring 13 is mounted on the bolt 10 and biased between the permanent magnet 20 and the fixing seat 30. A locking nut 15 is screwed onto the outer thread 12 of the bolt 10. A washer 14 is secured on the second end of the bolt 10 and connected to an electric wire 141 which is extended outward from the opening 341 of the peripheral wall 34 of the fixing seat 30 and connected to a motor power supply input (not shown). The washer 14 is movable to rest on the second side of the fixing seat 30.

The cover 40 has a substantially cylindrical shape and is mounted in the peripheral wall 34 of the fixing seat 30 to cover the bolt 10. The cover 40 has an outside formed with two radially opposite fixing ears 41 each rested on a respective one of the threaded posts 32 of the fixing seat 30 and each formed with a through hole 411, and the battery conducting device further comprises two locking screws 50 (see FIG. 3) each extended through the through hole 411 of a respective one of the fixing ears 41 of the cover 40 and each screwed into a respective one of the threaded posts 32 of the fixing seat 30 to secure the cover 40 on the fixing seat 30.

The electrode contact member 61 is rested on the flat plate 11 of the bolt 10 and attracted by the permanent magnet 20 so that the electrode contact member 61 is bonded on the flat plate 11 of the bolt 10 closely. Thus, the flat plate 11 of the bolt 10 is movable with the electrode contact member 61. The electrode contact member 61 is mounted on a bottom of a battery 60 and includes a conducting copper 65, a magnet 64 locked onto the conducting copper 65 by a screw 63, and an electric wire 62 attached to the screw 63.

In assembly, the fixing holes 33 of the fixing seat 30 are attached to a vehicle body 70 (see FIG. 5) of the motorized scooter by screws (not shown). As shown in FIG. 3, the electrode contact member 61 is attracted by the permanent magnet 20 so that the electrode contact member 61 is bonded on the flat plate 11 of the bolt 10 closely. In addition, the bolt 10 is connected to the electric wire 141 (by the washer 14) which is extended outward from the opening 341 of the peripheral wall 34 of the fixing seat 30 and connected to the motor power supply input.

Figure 4:
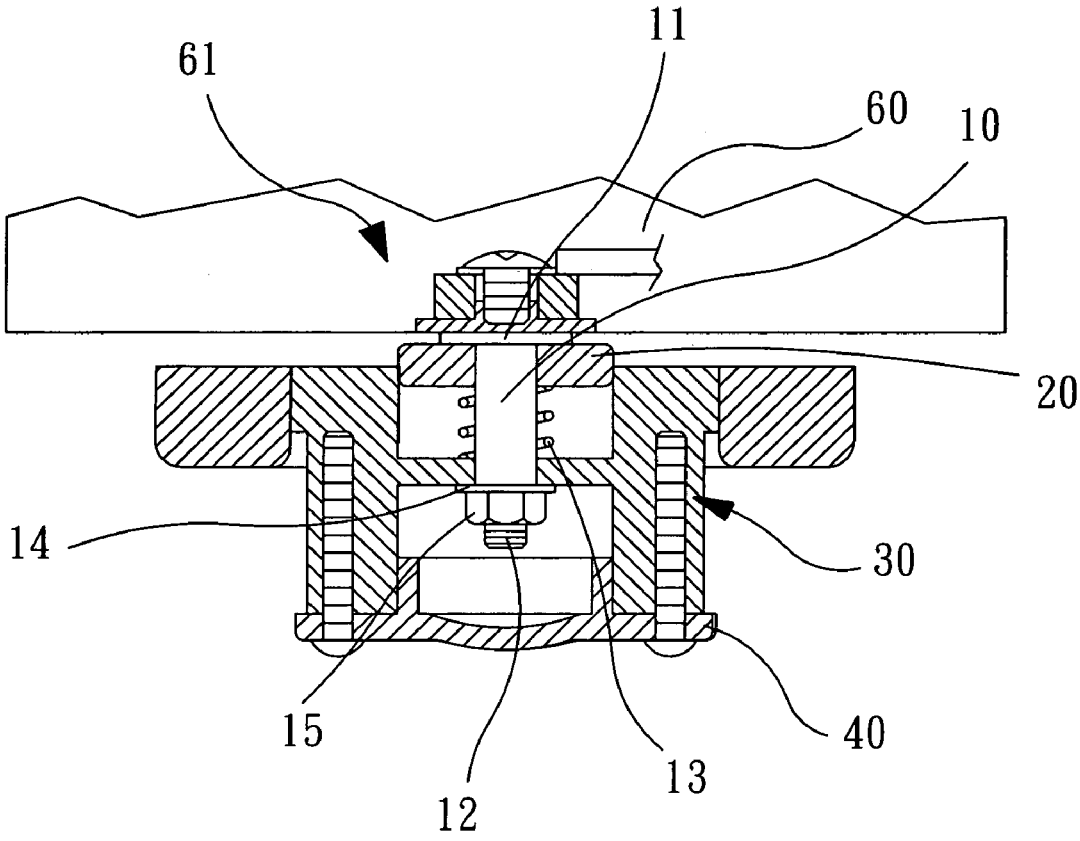
FIG. 4 is a schematic operational view of the battery conducting device as shown in FIG. 3.

As shown in FIG. 4, when the battery 60 is deviated from the original position due to a shock or vibration, the electrode contact member 61 is driven by the battery 60 to move outward relative to the fixing seat 30. At this time, the permanent magnet 20 is closely attached to the electrode contact member 61 by its stronger magnetically attractive force, so that the permanent magnet 20 is lifted by movement of the battery 60, and the bolt 10 is also moved upward with the permanent magnet 20. Thus, the flat plate 11 of the bolt 10 is connected to the electrode contact member 61 constantly, so that the bolt 10 is connected to the battery 60 constantly, thereby connecting the battery 60 to the motor power supply input successively so as to supply an electric power to the motorized scooter successively. In addition, the compression spring 13 that is mounted on the bolt 10 provides a shock-absorbing function.

Figure 5:
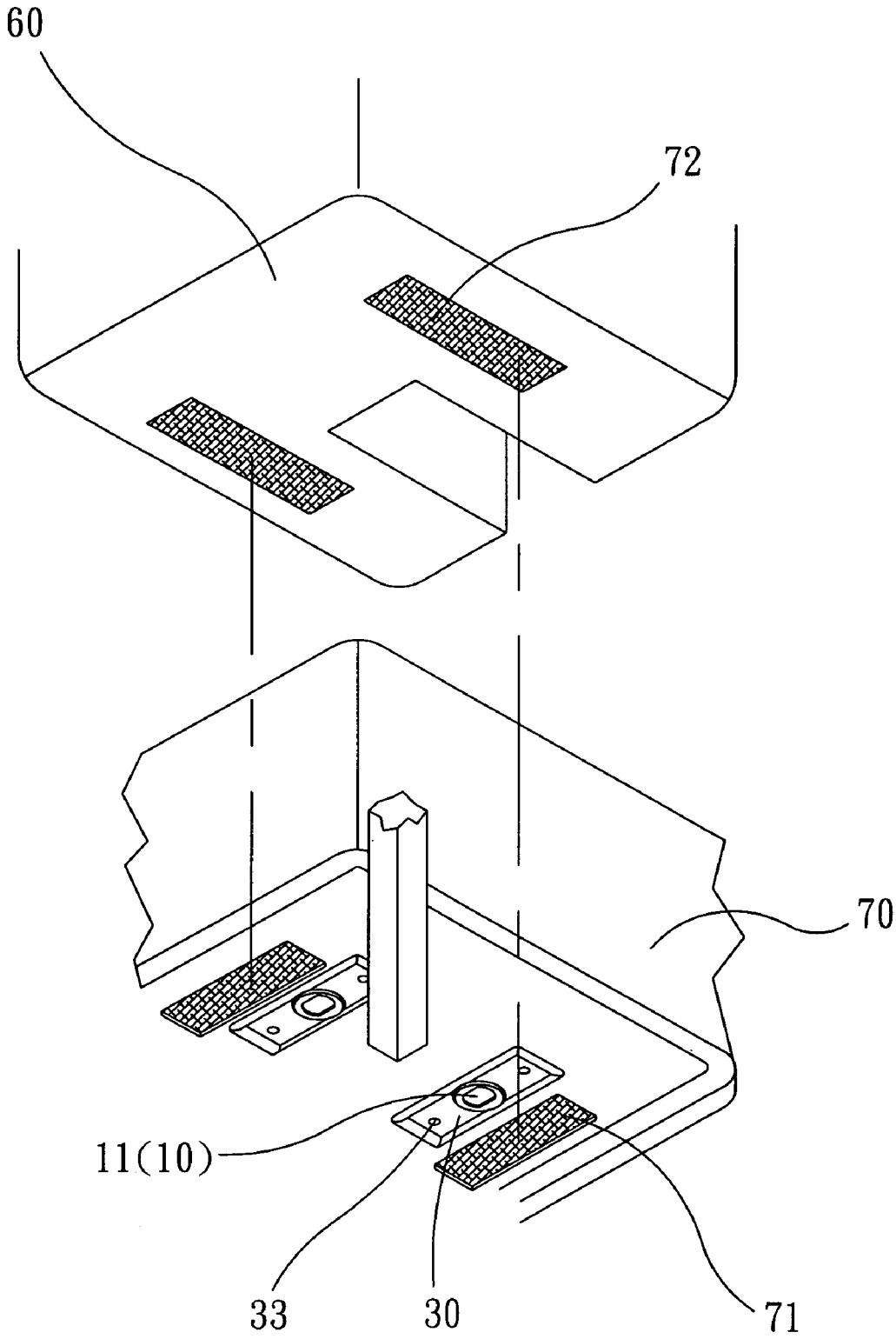
FIG. 5 is a partially exploded perspective view of a battery conducting device in accordance with another preferred embodiment of the present invention.

As shown in FIG. 5, the battery conducting device further comprises at least one first bonding strap 71 mounted on the vehicle body 70 of the motorized scooter, and at least one second bonding strap 72 mounted on the bottom of the battery 60 and detachably snapped onto the first bonding strap 71, so that the battery 60 is secured on the vehicle body 70 of the motorized scooter rigidly and stably.

Accordingly, the flat plate 11 of the bolt 10 is connected to the electrode contact member 61 constantly, so that the bolt 10 is connected to the battery 60 constantly, thereby connecting the battery 60 to the motor power supply input successively so as to supply an electric power to the motorized scooter successively without interruption due to a shock or vibration. In addition, the compression spring 13 mounted on the bolt 10 provides a shock-absorbing function to reduce the shock or vibration applied on the motorized scooter. Further, the battery 60 is secured on the vehicle body 70 of the motorized scooter rigidly and stably by the bonding straps.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A battery conducting device, comprising:

a fixing seat having a first side formed with a chamber;

a permanent magnet movably mounted in the chamber of the fixing seat;

a bolt movably mounted on the fixing seat and having a first end formed with a flat plate rested on the permanent magnet;

an electrode contact member rested on the flat plate of the bolt and attracted by the permanent magnet so that the electrode contact member is bonded on the flat plate of the bolt closely, and the flat plate of the bolt is movable with the electrode contact member.

2. The battery conducting device in accordance with claim 1, wherein the fixing seat is a substantially sheet plate.

3. The battery conducting device in accordance with claim 1, further comprising a compression spring mounted on the bolt and biased between the permanent magnet and the fixing seat.

4. The battery conducting device in accordance with claim 1, wherein the fixing seat has two ends each formed with a fixing hole.

5. The battery conducting device in accordance with claim 1, wherein the permanent magnet has an inside formed with a through hole, and the bolt is extended through the through hole of the permanent magnet.

6. The battery conducting device in accordance with claim 1, wherein the electrode contact member is mounted on a bottom of a battery and includes a conducting copper, a magnet locked onto the conducting copper by a screw, and an electric wire attached to the screw.

7. The battery conducting device in accordance with claim 1, further comprising at least one first bonding strap mounted on a vehicle body of a motorized scooter, and at least one second bonding strap mounted on a bottom of a battery and detachably snapped onto the first bonding strap, so that the battery is secured on the vehicle body of the motorized scooter.

8. The battery conducting device in accordance with claim 1, wherein the fixing seat has a second side formed with a peripheral wall having a side formed with an opening.

9. The battery conducting device in accordance with claim 8, wherein the peripheral wall of the fixing seat has a substantially cylindrical shape.

10. The battery conducting device in accordance with claim 8, wherein the chamber of the fixing seat has a face formed with a through hole, and the bolt has a second end extended the through hole of the fixing seat into the peripheral wall of the fixing seat and formed with an outer thread.

11. The battery conducting device in accordance with claim 10, further comprising a locking nut screwed onto the outer thread of the bolt.

12. The battery conducting device in accordance with claim 10, wherein the bolt is movably mounted in the through hole of the fixing seat.

13. The battery conducting device in accordance with claim 10, further comprising a washer secured on the second end of the bolt and connected to an electric wire which is extended outward from the opening of the peripheral wall of the fixing seat.

14. The battery conducting device in accordance with claim 13, wherein the washer is movable to rest on the second side of the fixing seat.

15. The battery conducting device in accordance with claim 8, further comprising a cover mounted in the peripheral wall of the fixing seat to cover the bolt.

16. The battery conducting device in accordance with claim 15, wherein the peripheral wall of the fixing seat has an outside formed with two radially opposite threaded posts, the cover has an outside formed with two radially opposite fixing ears each rested on a respective one of the threaded posts of the fixing seat and each formed with a through hole, and the battery conducting device further comprises two locking screws each extended through the through hole of a respective one of the fixing ears of the cover and each screwed into a respective one of the threaded posts of the fixing seat to secure the cover on the fixing seat.

17. The battery conducting device in accordance with claim 15, wherein the cover has a substantially cylindrical shape.

* * * * *